US010167629B2

(12) United States Patent
Ciuperca

(10) Patent No.: US 10,167,629 B2
(45) **Date of Patent: *Jan. 1, 2019**

(54) INSULATED REINFORCED FOAM SHEATHING, REINFORCED ELASTOMERIC VAPOR PERMEABLE AIR BARRIER FOAM PANEL AND METHOD OF MAKING AND USING SAME

(71) Applicant: Romeo Ilarian Ciuperca, Atlanta, GA (US)

(72) Inventor: Romeo Ilarian Ciuperca, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,436

(22) Filed: Sep. 19, 2017

(65) Prior Publication Data

US 2018/0030721 A1 Feb. 1, 2018

Related U.S. Application Data

(63) Continuation of application No. 15/436,985, filed on Feb. 20, 2017, now abandoned, which is a (Continued)

(51) Int. Cl.
*E04B 1/76* (2006.01)
*E04B 1/62* (2006.01)
(Continued)

(52) U.S. Cl.
CPC ..... *E04B 1/7629* (2013.01); *E04B 1/625* (2013.01); *E04B 1/66* (2013.01); *E04B 1/7612* (2013.01); *E04B 1/7633* (2013.01); *E04B 1/80* (2013.01); *E04B 2/04* (2013.01); *E04B 2/58* (2013.01); *E04B 2/706* (2013.01); *E04C 2/284* (2013.01); *E04C 2/34* (2013.01); *E04B 1/4178* (2013.01); *E04B 2002/565* (2013.01); *E04B 2002/7477* (2013.01)

(58) Field of Classification Search
CPC ..... E04B 1/7629; E04B 2002/7477
See application file for complete search history.

(56) References Cited

U.S. PATENT DOCUMENTS 2,307,348 A * 1/1943 Anderson ..... F16B 15/02 411/487
3,418,776 A * 12/1968 Manderbach ..... E04B 2/7854 52/241
8,555,583 B2 * 10/2013 Ciuperca ..... B23P 11/00 52/309.11

* cited by examiner

*Primary Examiner* — Patrick J Maestri
(74) *Attorney, Agent, or Firm* — Robert E. Richards; Richards IP Law

(57) ABSTRACT

The invention comprises a product. The product comprises a first foam panel having an edge, a first primary surface and an opposite second primary surface and a second foam panel having an edge, a first primary surface and an opposite second primary surface, wherein the first and second foam panels are disposed such that their edges are adjacent each other and define a joint therebetween. The product also comprises an elongate metal strip having a body portion and a projection extending outwardly from the body portion, the metal strip being disposed such that at least a portion of the projection is disposed in the joint between the foam panels and at least a portion of the body portion covers a portion of the second primary surface of the first foam panel and a portion of the second primary surface of the second foam panel. A method of making and using the composite panel is also disclosed.

11 Claims, 10 Drawing Sheets

Related U.S. Application Data continuation of application No. 14/847,152, filed on Sep. 8, 2015, now Pat. No. 9,574,341.

(60) Provisional application No. 62/047,829, filed on Sep. 9, 2014.

(51) Int. Cl.

| | |
|---|---|
| ***E04B 2/58*** | (2006.01) |
| ***E04C 2/284*** | (2006.01) |
| ***E04C 2/34*** | (2006.01) |
| ***E04B 2/70*** | (2006.01) |
| ***E04B 1/80*** | (2006.01) |
| ***E04B 1/66*** | (2006.01) |
| ***E04B 2/04*** | (2006.01) |
| *E04B 2/56* | (2006.01) |
| *E04B 1/41* | (2006.01) |
| *E04B 2/74* | (2006.01) |

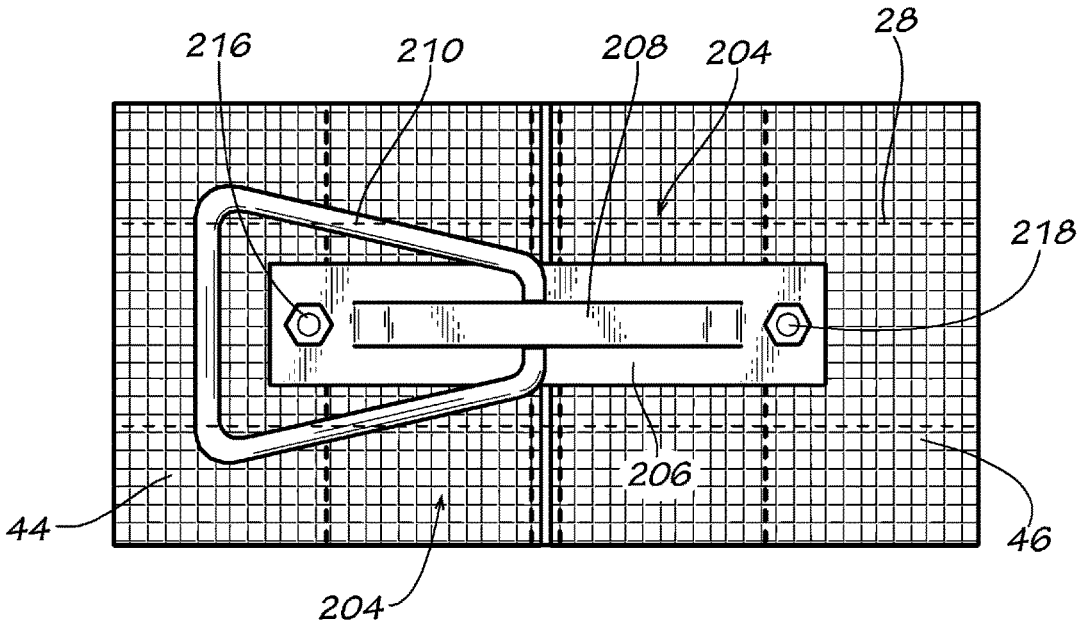
FIG. 14
FIG. 15
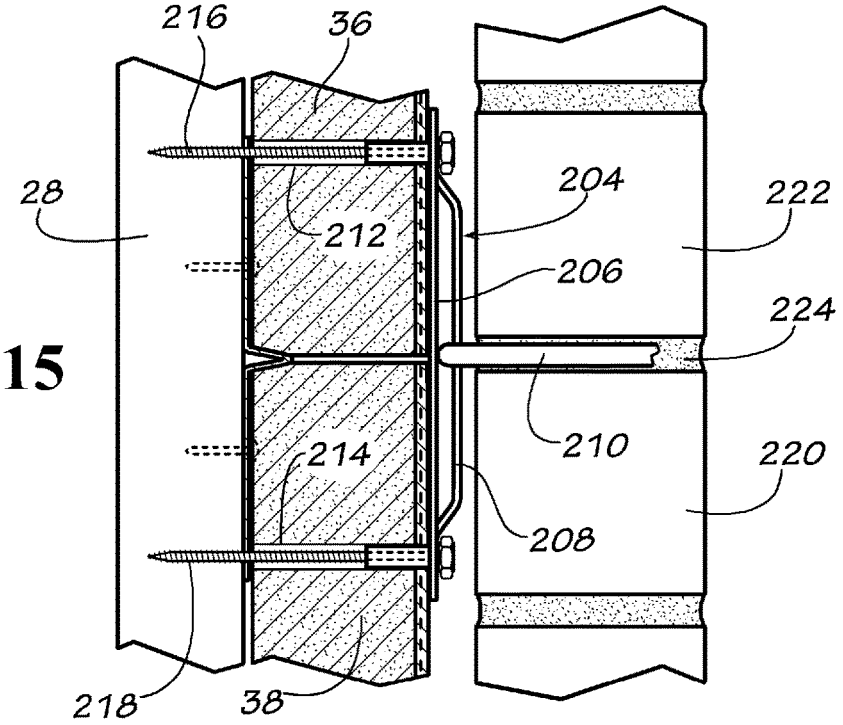

INSULATED REINFORCED FOAM SHEATHING, REINFORCED ELASTOMERIC VAPOR PERMEABLE AIR BARRIER FOAM PANEL AND METHOD OF MAKING AND USING SAME

CROSS-REFERENCE TO RELATED APPLICATIONS

This application is a continuation of application Ser. No. 15/436,985 filed Feb. 20, 2017, now abandoned, which is a continuation of application Ser. No. 14/847,152 filed Sep. 8, 2015, now U.S. Pat. No. 9,574,341, which claims the benefit of application Ser. No. 62/047,829 filed Sep. 9, 2014.

FIELD OF THE INVENTION

The present invention generally relates to sheathing. More particularly, this invention relates to a system for insulating structures, such as residential and commercial buildings. The present invention also relates to an insulated sheathing product. The present invention also relates to an insulated sheathing that is an air barrier but allows vapor transmission. The present invention also relates to making a reinforced foam panel fire resistant. The present invention also relates to an insulated sheathing in which the vapor permeability can be varied. The present invention also related to a reinforcing framing element to enhance the performance of insulated sheathing. The present invention also relates to a method of insulating structures, such as residential and commercial buildings.

BACKGROUND OF THE INVENTION

In buildings, energy loss takes place primarily through the building envelope. The building envelope consists of doors, windows, and exterior wall and roofing systems.

Walls typically use metal or wood studs to form a frame that can be either load bearing or infill. Multistory buildings can be made of a cast-in-place concrete or steel frame with the exterior perimeter walls being in-filled frame construction between the concrete or steel frame. Once the in-fill frame is installed, exterior sheathing is attached to the exterior side of the frame. On the inside, drywall is often used for the finished surface. This framing system creates a cavity between the exterior sheathing and the drywall. The wall cavity is then filled with batt insulation to insulate the building and improve energy efficiency. However, there are several drawbacks of this system. Framing members create thermal bridging. Batt insulation may not completely fill the cavity wall and over time it can sag leaving no insulation in some portions of the wall. Moisture condensation inside cavity walls is common which may dampen the batt insulation. When this occurs, the damp batt insulation loses most, if not all, insulating properties. In certain climates, a vapor barrier is required to be installed in the wall assembly. While this can help in certain seasons and climates, the year-round changes in temperature, humidity and pressure differential between the interior and exterior of the building make the use of vapor barriers problematic.

Building HVAC systems create pressure differentials between the interior and the exterior of the building. These pressure differentials cause air to move through the exterior wall system. This action is known as HVAC fan pressure. Along with wind, and atmospheric pressure changes, these factors cause air infiltration or exfiltration.

Wind pressure tends to positively pressurize a building on the façade against which it is blowing. And, as wind goes around a corner of a building it cavitates and speeds up considerably, creating especially strong negative pressures at corners and weaker negative pressure on the rest of the building walls and roof.

Stack pressure (or chimney effect) is caused by a difference in atmospheric pressure at the top and bottom of a building due to the difference in temperature, and, therefore, a difference in the weight of columns of air indoors vs. outdoors, especially in winter. In cold climates, stack effect can cause infiltration of air at the bottom of the building and exfiltration at the top. The reverse occurs in warm climates as a result of air-conditioning.

Fan pressure is caused by HVAC system pressurization, usually positively, which is beneficial in warm climates but can cause incremental enclosure problems to wind and stack pressures in climates requiring heating. Infiltration and exfiltration of air in buildings have serious consequences, when they are uncontrolled; the infiltrating air is untreated, and, therefore, can bring pollutants, allergens, and bacteria into buildings. Another serious consequence of infiltration and exfiltration through the building enclosure is condensation of moisture from the exfiltrating air in northern climates, and from infiltrating hot humid air in southern climates, causing mold growth, decay, and corrosion in the wall cavity. This can cause health problems for the building occupants and building material decay with premature building deterioration. Unlike the moisture transport mechanism of diffusion, air pressure differentials can transport hundreds of times more water vapor through air leaks in a building enclosure over the same period of time. This water vapor can condense within a building in a concentrated manner as the air contacts surfaces within the building that are at a temperature below the air's dew-point.

To improve energy efficiency, and to control air infiltration and exfiltration, building codes have recently required the use of air barriers on the exterior sheathing. Air barriers are required on the exterior sheathing to eliminate air exchange. The important features of an air barrier system are: continuity, structural support, air impermeability, and durability. An air barrier has to be continuous and must be interconnected to seal all other elements such as windows, doors and penetrations. Effective structural support requires that any component of an air barrier system must resist the positive or negative structural loads that are imposed on that component by wind, stack effect, and HVAC fan pressures without rupture, displacement or undue deflection. This load must then be safely transferred to the structure. Materials selected to be part of an air barrier system should be chosen with care to avoid materials that are too air-permeable, such as fiberboard, perlite board, and uncoated concrete block. The air permeance of a material is measured using ASTM E 2178 test protocol and is reported in Liters/second per square meter at 75 Pa pressure (cfm/ft$^2$ at 0.3" w·g or 1.57 psf). The Canadian and IECC codes and ASHRAE 90.1-2010 consider 0.02 L/s·m$^2$ 75 Pa (0.004 cfm/ft$^2$ at 1.57 psf), which happens to be the air permeance of a sheet of ½" unpainted gypsum wall board, as the maximum allowable air leakage for a material that can be used as part of an air barrier system for an opaque enclosure. In order to achieve an airtight structure, the basic materials selected for the air barrier must be highly air-impermeable. The U.S. Army Corps of Engineers (USACE) and the Naval Facilities Command (NAVFAC) have established 0.25 cfm/ft$^2$ at 1.57 psf (1.25 L/s·m$^2$ at 75 Pa) as the maximum air leakage for an entire building (airflow tested in accordance with the USACE/ABAA Air Leakage Test Protocol, which incorporates ASTM E 779); whereas the U.S. Air Force and the International Green Construction Code (IgCC) specify 0.4 cfm/ft$^2$ at 1.57 psf ((2.0 L/s·m$^2$@ 75 Pa) divided by the area of the enclosure pressure boundary). Materials selected for an air barrier system must perform their function for the expected life of the structure; otherwise they must be accessible for periodic maintenance.

An air barrier, unlike the vapor retarder (which stops air movement, but does not control diffusion), can be located anywhere in an enclosure assembly. If it is placed on the predominantly warm, humid side (high vapor pressure side) of an enclosure or building, it can control diffusion as well, and should be a low-perm vapor barrier material. In such case, it is called an "air and vapor barrier." If placed on the predominantly cool, drier side (low vapor pressure side) of an enclosure or building, it should be vapor permeable (5-10 perms or greater).

Air barriers can have different vapor permeability ratings. Various building codes bodies classify them as vapor permeable, vapor barriers (vapor impermeable) and vapor retarders (vapor semi-permeable). Elastomeric vapor permeable air barrier have a vapor permeability rating of at least 1-10 perms. Vapor impermeable air barriers have a vapor permeability rating of less than 0.1 perms. Vapor retardant air barriers have a vapor permeability rating of between 0.1 perms and 1 perm.

The ASHRAE Standard 90.1 classifies the 50 states of the USA in at least 8 distinct climate zones. Building codes require a continuous air barrier membrane over the exterior of a building and a continuous foam insulation layer over the structural framing members in all climate zones. However depending on the climate zone, the air barrier requirement can be any one of the three discussed above. For example in hot climates, such a Zones 2 and 3, an air barrier has to be vapor permeable, while in very cold climate, such as Zone 7, an air barrier has to be vapor impermeable. These various factors make it challenging to product manufacturers, designers and contractors to provide the proper solution for each location.

Walls constructed from materials that are very permeable to air, must be air tightened using an applied elastomeric (flexible) coating, either as a specially formulated coating, or a specially formulated air barrier sheet product, or a fluid-applied spray-on or trowel-on material. It has been found that elastomeric polymer coatings are the most effective type of products that meet all of the above criteria.

Elastomeric products used currently as air membranes meet all of the above concerns. Air membranes stop air and water but allow water vapors under pressure differential. They are designed to resist stresses and rupture. The code requires that air membranes have an elongation factor of at least 300%. Aluminum foils are used to laminate many types of sheathing products, such as plywood or foam. Aluminum foils have good infrared reflective properties, thus reflecting heat and improving energy efficiency of the products they are laminated to. Also, aluminum foils, just like all other foil types, are good vapor barriers and do not allow any vapor permeance. Therefore, aluminum foiled faced products are of limited utility where a vapor membrane is required. By code aluminum foil faced products cannot be used in applications where vapor permeability is required. It would be of great benefit if an air barrier could have heat reflective properties; i.e., infrared and heat reflective properties similar to the aluminum foils and in addition meet all code mandated requirement.

Thermal performance of the building envelope influences the energy demand of a building in two ways. It affects annual energy consumption, and, therefore, the operating costs for building heating, cooling, and humidity control. It also influences peak energy requirements, which consequently determine the size of heating, cooling and energy generation equipment and in this way has an impact on investment costs. In addition to energy saving and investment cost reduction, a better insulated building provides other significant advantages, including higher thermal comfort because of warmer interior surface temperatures in winter and lower temperatures in summer. This also results in a lower risk of mold growth on internal surfaces.

As can be seen, an air barrier system and building insulation are essential components of the building envelope so that air pressure relationships within the building can be controlled, building HVAC systems can perform as intended, and the occupants can enjoy healthy indoor air quality and a comfortable environment, while reducing energy consumption. HVAC system size can be reduced because of a reduction in the added capacity to cover infiltration, energy loss and unknown factors, resulting in reduced energy use and demand. Air barrier and building insulation systems in a building envelope can also control concentrated condensation and the associated mold, corrosion, rot, and premature failure; and they also improve and promote durability and sustainability. Current building practices typically use gypsum board or plywood sheathing over the exterior metal or wood framing. In the past, other types of sheathing made of pressed board, asphalt impregnated fiberboard, cement board, aluminum and polyethylene foil-faced foam board have been used over the exterior framing. However due to code requirements to use an air barrier over the exterior sheathing, only materials compatible with elastomeric coatings are being used as sheathing, such as gypsum board and plywood.

Gypsum sheathing has an advantage in that it is fire-resistant; however gypsum has very low insulating value. Gypsum sheathing with glass matt can only resist relatively low impact levels and fails to meet missile impact test requirements associated with coastal construction. Plywood and wood sheathing can meet missile impact test requirements; however, it also has very low insulating value. Both gypsum sheathing and wood sheathing are compatible with and can be coated by liquid applied elastomeric air barriers that meet building code compliance requirements. After plywood or wood sheathing is installed, the sheathing joints are taped and sealed. The exterior of the board is coated with an elastomeric air barrier membrane. Then, to meet code requirements of providing continuous insulation over the structural members, a layer of insulation board is installed. Plastic foam insulation provides good continuous insulation, but does not have any significant structural properties. Therefore, plastic foam insulation is attached over exterior sheathing. However, when this is done, the elastomeric air barrier membrane is penetrated. This can subject the air barrier to moisture and air infiltration and exfiltration risks. To mitigate this problem, aluminum foil insulating boards can be used over the exterior sheathing, such as Thermax polyisocyanurate aluminum foil faced insulation board by Dow Chemical. However, aluminum foil insulating boards have a vapor permeability rating of less than 0.04 Perms. Foil faced rigid board insulation provides a good vapor barrier, but cannot be used in climate zones and applications where the air barrier must be vapor permeable. While plastic foam boards are good insulators they have very poor fire resistance properties. Most plastic foam boards are combustible or melt under fire.

Conventional sheathing is attached to framing elements. Framed walls generally have a top and bottom track with vertical studs attached to each. To increase the load bearing capacity and structural performance of such a wall, horizontal bracing is frequently used to reinforce the vertical studs. The horizontal bracing can be either internal or external and generally is spaced at 4 to 6 feet intervals. Such horizontal bracing keep the studs from buckling and keeps them securely in place under structural stresses. For metal stud framing, internal bracing is generally a single channel attached by various means to each stud through a punched opening in the studs. Exterior bracing is typically a flat metal strap attached to both faces of the studs to keep them equal spaced under stress. The metal strap is flat so that the sheathing can lay flat and continuous over the exterior framing members. In residential wood framing construction, a "T" bar framing element is used for shear or lateral bracing. Conventional sheathing products, such as plywood, OSB and gypsum board, require a flat framing surface to allow for proper installation. Therefore, "T" members can only be used if the leg is embedded into the studs and the top portion is run flat on the face of the stud framing. To install a "T" bar, a cut is usually made into the wood studs to create a recessed channel where the leg of the "T" element is embedded so that the top portion of the "T" element lys flat on the exterior face of the stud framing providing a generally flat surface for sheathing installation. A piece of flat strap element is relatively strong in tension and relatively weak in compression over the length of it. "T" bar framing elements are stronger than a flat strap piece of metal both in tension and compression. "T" framing elements provide superior structural reinforcement against buckling or shear forces than flat strap. However due to the need to be embed a portion of the "T" into the studs, "T" reinforcing elements are usually only used in wood framing construction. Metal studs generally cannot be cut to allow for the embedment of a portion of the "T" member, as they would lose their structural integrity. Sheathing materials and especially wood-type sheathing, such as plywood and OSB, are used to provide structural reinforcement against shear and buckling forces to framing systems in ways that gypsum board and foam-type sheathing cannot provide.

Once the building envelope is air tight, architectural wall claddings are installed on the exterior face of the exterior sheathing with the air barrier membrane and continuous plastic foam insulation on it. Stucco, brick, tile, stone, wood siding, metal panels, cement board and EIFS are popular types of exterior wall claddings. With the exception of EIFS, all of these wall claddings have to be mechanically attached to the structural framing members. The mechanical anchors penetrate the air barrier and the sheathing thereby increasing the risk of air infiltration and exfiltration.

Therefore, the new energy code compliant building envelope is comprised of several different materials and components manufactured by different companies and sold and installed by a number of different contractors. This process is labor intensive, time consuming and expensive. As a result, the cost of building an airtight and energy efficient building envelope has risen sharply over the past several years and will continue to rise.

To meet all of the above challenges in all climate zones and applications and to keep cost down, it would be desirable to provide an exterior sheathing product that has an air barrier membrane built into it. It also would be advantageous if the air barrier membrane properties could be adjusted to achieve any desired vapor permeability value; i.e., from a high vapor permeability rating to a low vapor permeable rating to a vapor impermeability rating. It would be desired for the air barrier sheathing to have insulating properties. It would also be desirable that the exterior insulating sheathing product is structurally sound and can resist the positive or negative structural loads that are imposed on a building by wind, stack effect, and HVAC fan pressures without rupture, displacement or undue deflection. It is desirable that these loads are safely transferred to the associated structure. It would be desirable that the exterior sheathing product has fire resistant properties. It would also be desirable that the exterior sheathing allows a wide variety of wall claddings to be attached to it without penetrating the air barrier. The construction industry would benefit tremendously from a sheathing product that has built into it all of the above properties required by building codes. Such a sheathing product would eliminate the current use of multiple products and reduce labor, time and cost of installation.

SUMMARY OF THE INVENTION

The present invention satisfies the foregoing needs by providing an improved insulating system for structures, such as residential and commercial buildings.

In one disclosed embodiment, the present invention comprises a product. The product comprises a first foam panel having an edge, a first primary surface and an opposite second primary surface and a second foam panel having an edge, a first primary surface and an opposite second primary surface, wherein the first and second foam panels are disposed such that their edges are adjacent each other and define a joint therebetween. The product also comprises an elongate metal strip having a body member and a projection extending outwardly from the body member, the metal strip being disposed such that at least a portion of the projection is disposed in the joint between the foam panels and at least a portion of the body member covers a portion of the second primary surface of the first foam panel and a portion of the second primary surface of the second foam panel.

In another disclosed embodiment, the present invention comprises a wall structure. The wall structure comprises a plurality of vertical stud members horizontally spaced from each other to form a wall framing structure and an elongate metal strip having a body member and a projection extending outwardly from the body member, the metal strip being attached to at least two adjacent vertical stud members. The wall structure also comprises a first foam panel having an edge and a second foam panel having an edge, wherein the first and second foam panels are disposed such that their edges are adjacent each other and define a joint therebetween and wherein the metal strip is disposed such that at least a portion of the projection is disposed in the joint between the first and second foam panels.

In another disclosed embodiment, the present invention comprises a method. The method comprises securing an elongate metal strip to adjacent wall studs, the elongate metal strip having a body member and a projection extending outwardly from the body member. The method further comprises securing a composite insulated panel to the structure. The composite insulated panel comprises a foam insulating panel having an edge, a first primary surface and an opposite second primary surface. The foam insulating panel is disposed such that the projection is adjacent the edge of the foam insulating panel and at least a portion of the second primary surface covers at least a portion of the body member.

Accordingly, it is an object of the present invention to provide an improved insulating system.

Another object of the present inventions is to provide an insulating board that is vapor permeable but prevents air leakage through a building envelope.

Another object of the present inventions is to provide a reinforced foam panel and sheathing material with improved insulating and fire resistance properties.

Another object of the present inventions is to provide a reinforced foam panel and sheathing material with improved structural properties.

Another object of the present inventions is to provide a reinforced foam panel and sheathing material with improved insulating and fire resistance properties Another object of the present invention is to provide a reinforced foam panel with improved properties that can be used as a substrate for exterior wall claddings Another object of the present invention is to provide insulated foam sheathing for use in insulating structures, such as residential and commercial buildings.

Another object of the present invention is to provide insulated foam sheathing for use in insulating walls.

Another object of the present invention is to provide insulated foam sheathing for use in insulating roofs.

Another object of the present invention is to provide an improved method for insulating structures, such as residential and commercial buildings.

A further object of the present invention is to provide a more efficient way of insulating structures, such as residential and commercial buildings.

Another object of the present invention is to provide an improved system for attaching foam sheathing panels to a building structure.

Another object of the present invention is to provide an improved insulated sheathing system in which the vapor permeability can be varied; i.e., increased or decreased.

Another object of the present invention is to provide an improved insulating sheathing system that is vapor permeable and has heat reflective properties to improve the energy efficiency of building envelopes.

A further object of the present invention is to provide an improved insulating sheathing system that is vapor permeable and also has infrared reflective properties to improve the energy efficiency of building envelopes.

Another object of the present invention is to provide an improved insulated sheathing system that prevents water instruction.

A further object of the present invention is to provide an improved insulated sheathing system that reduces, or eliminates, the need for horizontal bracing.

Yet another object of the present invention is to provide an improved insulated sheathing system that also provides a brick tie system.

These and other objects, features and advantages of the present invention will become apparent after a review of the following detailed description of the disclosed embodiments and the appended drawing and claims.

BRIEF DESCRIPTION OF THE DRAWINGS

FIG. 14 is a top plan view of the brick tie shown in FIG. 12 shown in use with a disclosed embodiment of the insulated wall sheathing system in accordance with the present invention.

FIG. 15 is a partial side cross-sectional view of the brick tie shown in FIG. 12 shown in use with a disclosed embodiment of the insulated wall sheathing system in accordance with the present invention.

DETAILED DESCRIPTION OF THE DISCLOSED EMBODIMENTS

Applicant's U.S. Pat. No. 8,966,845 is incorporated herein by reference in its entirety.

Figure 1:
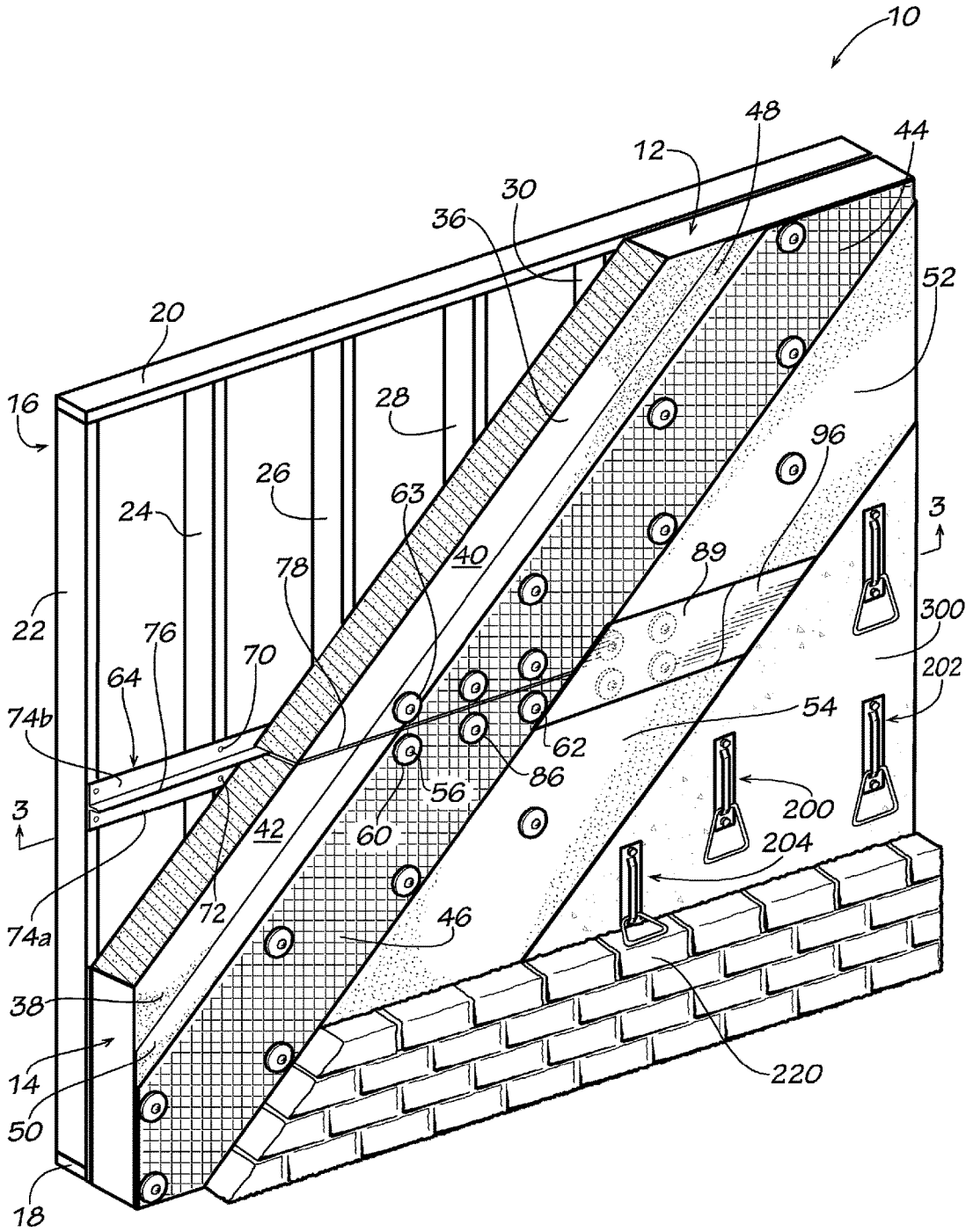
FIG. 1 is a partially cut away perspective view of a disclosed embodiment of an insulated wall sheathing system in accordance with the present invention.
Figure 2:
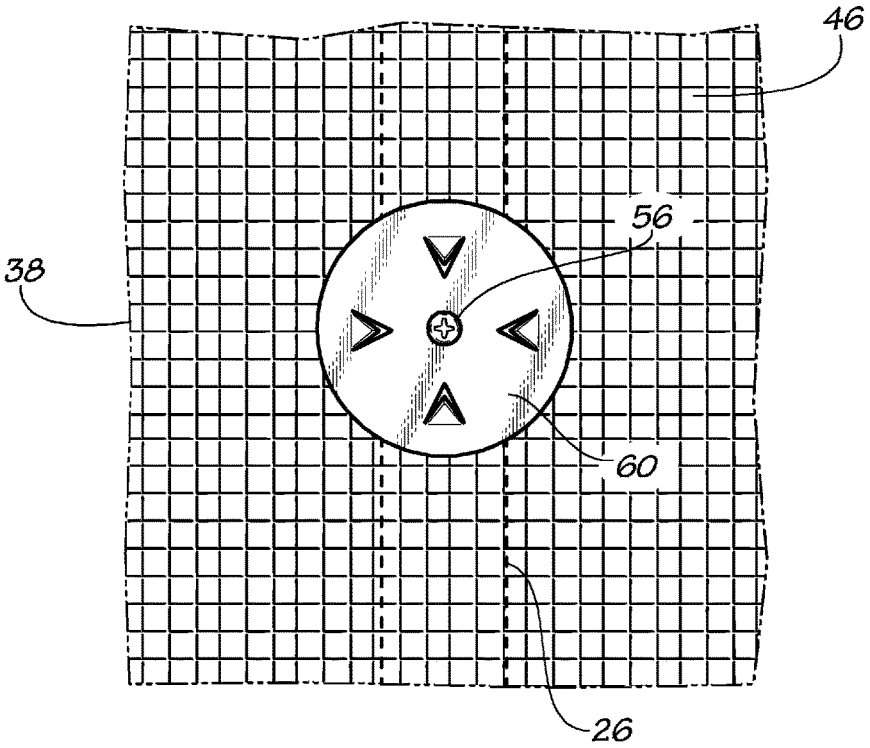
FIG. 2 is a partial detailed plan view of the exterior surface of the composite insulated panel shown in FIG. 1 showing a layer of reinforcing material at least partially disposed under a washer and a screw for attaching the composite insulated panel to a building structure.

Referring now to the drawing in which like numbers indicate like elements throughout the several views, there is shown in FIG. 1 a disclosed embodiment of an insulated sheathing system 10 in accordance with the present invention. The insulated sheathing system 10 includes a first composite insulated panel 12 and a second composite insulated panel 14 attached to a conventional stud wall 16. The stud wall 16 comprises a horizontal bottom track 18 and a horizontal top track 20. Disposed between the bottom track 18 and the top track 20 are a plurality of vertical studs 22, 24, 26, 28, 30. The vertical studs 22-30 are typically made from 2"×4" or 2"×6" pine and usually in lengths of 8 feet, 9 feet or 10 feet. The vertical studs 22-30 shown in FIG. 1 are 2"×4"×8'. Although the vertical studs 22-30 are shown as being made from wood, other materials including, but not limited to, metal, such as steel or aluminum, or composite materials can be used for the vertical studs.

Each of the composite insulated panels 12, 14 comprises a rectangular foam insulating panel 36, 38. The foam insulating panels 36, 38 can be made from any thermal insulating material that is sufficiently rigid to withstand anticipated wind loads. The foam insulating panels 36, 38 preferably are made from a closed cell polymeric foam material, such as molded expanded polystyrene foam or extruded polystyrene foam. Other polymeric foams can also be used including, but nor limited to, polyisocyanurate and polyurethane. If the foam insulating panels 36, 38 are made from expanded polystyrene foam, the foam insulated panels a should be at least 1 inch thick, preferably between 2 and 8 inches thick, especially at least 2 inches thick; more especially at least 3 inches thick, most especially at least 4 inches thick. If the foam insulating panels 36, 38 are made from a material other than polystyrene, the foam insulating panels should have insulating properties equivalent to at least 1 inch of expanded polystyrene foam, preferably between 2 and 8 inches of expanded polystyrene foam, especially at least 2 inches of expanded polystyrene foam; more especially at least 3 inches of expanded polystyrene foam, most especially at least 4 inches of expanded polystyrene foam.

The foam insulating panels 36, 38 should also have a density sufficient to make them substantially rigid, such as approximately 1 to approximately 3 pounds per cubic foot, preferably approximately 1.5 pounds per cubic foot. High density expanded polystyrene is available under the trademark Neopor® and is available from Georgia Foam, Gainesville, Ga. The foam insulating panels 36, 38 can be made by molding to the desired size and shape, by cutting blocks or sheets of pre-formed expanded polystyrene foam into a desired size and shape or by extruding the foam in a desired shape and then cutting the foam to a desired length. Although the foam insulating panels 36, 38 can be of any desired size and thickness, it is specifically contemplated that the foam insulating panels will conveniently be 4 feet wide and 8 feet long, 4 feet wide and 10 feet long or 4 feet wide and 12 feet long and 4 inches thick.

Applied to the exterior surface (a first primary surface) 40, 42 of each of the foam insulating panel 36, 38, respectively, is a layer of reinforcing material 44, 46, respectively. The layers of reinforcing material 44, 46 make the foam insulating panels 36, 38 more rigid, allow for embedment and gauge the thickness of the elastomeric air barrier. They can also assist in attaching the foam insulating panels to a building structure and attaching exterior finishes to the foam insulating panels. The layers of reinforcing material 44, 46 are made from porous materials, such as woven and nonwoven materials. As used herein the term "porous material" does not include metal screens, metal meshes, metal grids and other similar structures. To achieve a vapor permeability rating, the layers of reinforcing material 44, 46 specifically are not made from continuous materials, such as films, foils, metal sheets and other similar nonporous materials.

Nonwoven fabrics are broadly defined as sheet or web structures bonded together by entangling fiber or filaments (and by perforating films) mechanically, thermally or chemically. They are flat or tufted porous sheets that are made directly from separate fibers, molten plastic or plastic film. They are not made by weaving or knitting and do not require converting the fibers to yarn. Nonwoven fabrics provide specific functions such as liquid repellence, strength, flame retardancy, thermal insulation, acoustic insulation, and filtration. Nonwovens are typically manufactured by putting small fibers together in the form of a sheet or web (similar to paper on a paper machine), and then binding them either mechanically (as in the case of felt, by interlocking them with serrated needles such that the inter-fiber friction results in a stronger fabric), with an adhesive, or thermally (by applying binder in the form of powder, paste, or polymer melt and melting the binder onto the web by increasing temperature).

Staple nonwovens are made in four steps. Fibers are first spun, cut to a few centimeters in length, and put into bales. The staple fibers are then blended, "opened" in a multistep process, dispersed on a conveyor belt, and spread in a uniform web by a wetlaid, airlaid, or carding/crosslapping process. Wetlaid operations typically use ¼" to ¾" long fibers, but sometimes longer if the fiber is stiff or thick. Airlaid processing generally uses 0.5" to 4.0" fibers. Carding operations typically use ~1.5" long fibers. Rayon used to be a common fiber in nonwovens, now greatly replaced by polyethylene terephthalate (PET) and polypropylene (PP). Fiberglass is wetlaid into mats. Synthetic fiber blends are wetlaid along with cellulose. Staple nonwovens are bonded either thermally or by using resin. Bonding can be throughout the web by resin saturation or overall thermal bonding or in a distinct pattern via resin printing or thermal spot bonding. Conforming with staple fibers usually refers to a combination with meltblown. Meltblown nonwovens are produced by extruding melted polymer fibers through a spinneret or die consisting of up to 40 holes per inch to form long thin fibers which are stretched and cooled by passing hot air over the fibers as they fall from the die. The resulting web is collected into rolls and subsequently converted to finished products. The extremely fine fibers (typically polypropylene) differ from other extrusions, particularly spun bond, in that they have low intrinsic strength but much smaller size offering key properties. Often meltblown fibers are added to spun bond fibers to form SM or SMS webs, which are strong and offer the intrinsic benefits of fine fibers, such as acoustic insulation.

Nonwovens can also start with films and fibrillate, serrate or vacuum-form them with patterned holes. Fiberglass nonwovens are of two basic types. Wet laid mat or "glass tissue" use wet-chopped, heavy denier fibers in the 6 to 20 micrometer diameter range. Flame attenuated mats or "batts" use discontinuous fine denier fibers in the 0.1 to 6 range. The latter is similar, though run at much higher temperatures, to meltblown thermoplastic nonwovens. Wet laid mat is typically wet resin bonded with a curtain coater, while batts are usually spray bonded with wet or dry resin. An unusual process produces polyethylene fibrils in a Freon-like fluid, forming them into a paper-like product and then calendering them.

Both staple and spunlaid nonwovens would have no mechanical resistance in and of themselves, without the bonding step. Several methods can be used: thermal bonding, heat sealing using a large oven for curing, calendering through heated rollers (called spunbond when combined with spunlaid webs), calenders can be smooth faced for an overall bond or patterned for a softer, more tear resistant bond, hydro-entanglement (mechanical intertwining of fibers by water jets, often called spunlace), ultrasonic pattern bonding, needlepunching/needlefelting (mechanical intertwining of fibers by needles), and chemical bonding (wetlaid process—use of binders, such as latex emulsion or solution polymers, to chemically join the fibers, meltblown (fibers are bonded as air attenuated fibers intertangle with themselves during simultaneous fiber and web formation). Synthetic fabrics are man-made textiles rather than natural fibers. Some examples of synthetic fabrics are polyester, acrylic, nylon, rayon, acetate, spandex, lastex (yarn made from a core of latex rubber covered with fabric strands) and Kevlar® (aramid fibers). Synthetic fibers are made by the joining of monomers into polymers, by the process of polymerization. The fabric is made from chemically produced fibers. The chemicals are in liquid form and are forced through tiny holes called spinnerets. As the liquid comes out of the spinnerets and into the air, it cools and forms into tiny threads.

The layers of reinforcing material 44, 46 are preferably porous fabrics, webs or meshes, such as nonwoven plastic sheets for example a nonwoven polyester or a nonwoven fiberglass matt, or a woven or nonwoven fiberglass mesh or grid. The layers of reinforcing material 44, 46 can be made from materials such as polymer fibers, for example polyethylene, polystyrene, vinyl, polyvinyl chloride (PVC), polypropylene or nylon, from fibers, such as fiberglass, basalt fibers, and aramid fibers or from composite materials, such as carbon fibers in polymeric materials (but not metal wire meshes or metal wire grids). Nonwoven fiber meshes and grids are available from Chomarat North America, Anderson, S.C., USA. An especially preferred material for use as the layers of reinforcing material 44, 46 is a commercially available product designated as PermaLath® nonmetallic, self-furring lath from BASF, Cleveland, Ohio, USA and also disclosed in U.S. Pat. Nos. 7,625,827 and 7,902,092 (the disclosures of which are both incorporated herein by reference in their entirety). The layers of reinforcing material 44, 46 also can be made from the mesh (or lath) disclosed in any of U.S. Pat. Nos. 5,836,715; 6,123,879; 6,263,629; 6,454,889; 6,632,309; 6,898,908 or 7,100,336 (the disclosures of which are all incorporated herein by reference in their entirety). A particularly preferred material for the layers of reinforcing material 44, 46 is a woven fiberglass mesh, a woven fiberglass fabric and a nonwoven fiberglass matt available from JPS Composite Materials, Anderson, S.C., USA.

The layers of reinforcing material 44, 46 are adhered to the exterior surfaces 40, 42 of the foam insulating panels 36, 38, respectively. It is preferred that the layers of reinforcing material 44, 46 are laminated to the exterior surfaces 40, 42 of the foam insulating panel 36, 38 using a polymeric elastomeric material that forms an air barrier on the exterior surface of the foam insulating panels, but also allows a desired amount of vapor permeability, but does not allow air transmission. Vapor permeable air barrier layers 48, 50 can be applied to the exterior surfaces 40, 42 of the foam insulating panels 36, 38, respectively, by any suitable method, such as by spraying, brushing or rolling, and then applying the layers of reinforcing material 44, 46 thereto. Alternately, the layers of reinforcing material 44, 46 can be applied to the exterior surfaces 40, 42 of the foam insulating panels 36, 38, respectively, and then the vapor permeable air barrier layers 52, 54 can be applied to the layers of reinforcing material by any suitable method, such as by spraying, brushing or rolling. Preferably, the elastomeric vapor permeable air barrier layers 48, 50 can be applied to the exterior surfaces 40, 42 of the foam insulating panels 36, 38, respectively, and then the layers of reinforcing material 44, 46 can be applied to the elastomeric vapor permeable air barrier layers 51, 54 followed by the vapor permeable air barrier layers 52, 54 applied to the layers of reinforcing material. The elastomeric vapor permeable air barrier layers 48, 50 can be applied as the laminating agent for the layers of reinforcing material 44, 46 or it can be applied in addition to an adhesive used to adhere the layer of reinforcing material to the exterior surfaces 40, 42 of the foam insulating panels 36, 38. Preferably, the layers of reinforcing material 40, 42 are at least partially embedded in the elastomeric vapor permeable air barrier layers 48-54. Suitable polymeric materials for use as the vapor permeable air barrier layers 48-54 are any water-resistant polymeric material that is compatible with both the material from which the layer of reinforcing material 44, 46 and the foam insulating panel 36, 38 are made; especially, liquid applied polymeric elastomeric vapor permeable air barrier membrane materials.

A preferred vapor permeable air barrier membrane 48-54 is made from a combination of the liquid vapor permeable air barrier membrane material, such as a polymeric elastomeric coating, and 0.1% to approximately 50% by weight ceramic fibers, preferably 0.1% to 40% by weight, more preferably 0.1% to 30% by weight, most preferably 0.1% to 20% by weight, especially 0.1% to 15% by weight, more especially 0.1% to 10% by weight, most especially 0.1% to 5% by weight. Ceramic fibers are fibers made from materials including, but not limited to, silica, silicon carbide, alumina, aluminum silicate, aluminum oxide, zirconia, calcium silicate and combinations thereof. Wollastonite is an example of a ceramic fiber. The above fibers can be used in any number of ways and combination percentages, not just as a single element added to the elastomeric material. Wollastonite is a calcium inosilicate mineral ($CaSiO_3$) that may contain small amounts of iron, magnesium, and manganese substituted for calcium. Wollastonite is available from NYCO Minerals of NY, USA. Bulk ceramic fibers are available from Unifrax I LLC, Niagara Falls, N.Y., USA. Ceramic fibers are known to block heat transmission and especially radiant heat. Ceramic fibers can help improve the energy efficiency and fire resistance of the elastomeric vapor permeable air barrier membrane and of the composite insulated foam panel.

Optionally, Wollastonite, other mineral oxides, such as magnesium oxide and aluminum oxide, fly ash, rice husk ash or fire clay or any other fire resistant fillers, can be added to the vapor permeable air barrier membrane material, in the above mentioned quantities, to both increase resistance to heat transmission, improve radiant heat insulation properties and act as a fire retardant. Therefore, the elastomeric vapor permeable air barrier materials can obtain fire resistance properties. A fire resistant vapor permeable air barrier membrane over the exterior surface of the foam insulating panel can increase the fire rating of the wall assembly and delay the melting of the foam insulating panels.

Alternatively, the vapor permeable air barrier membrane 48-54 can be made from a combination of the liquid vapor permeable air barrier membrane material, such as a polymeric elastomeric coating, and approximately 0.1% to approximately 50% by weight heat reflective elements, preferably approximately 0.1% to approximately 40% by weight, more preferably approximately 0.1% to approximately 30% by weight, most preferably approximately 0.1% to approximately 20% by weight, especially approximately 0.1% to approximately 15% by weight, more especially approximately 0.1% to approximately 10% by weight, most especially approximately 0.1% to approximately 5% by weight. Heat reflective elements are made from materials including, but not limited to, mica, aluminum flakes, magnetite, graphite, carbon, other types of silicates and combinations thereof. The above heat reflective elements can be used in any number ways and combination percentages, not just as a single element added to the elastomeric material. The heat reflective elements can also be used in conjunction with the ceramic fibers mentioned above in any number of ways and percentage combinations. The vapor permeable membrane will thus have infrared or heat reflective properties for improved insulating and energy efficiency properties. Preferably, the vapor permeable air barrier layers 48, 50 and/or 52, 54 are water resistant. Vapor permeable weather and air barriers have to allow the desired amount of vapor transmission under pressure differential but have to stop the water infiltration into the building envelope. It is also preferred that the air barrier layers 48, 50 and/or 52, 54 are vapor permeable. Thus, the vapor permeable air barrier layers 48, 50 and/or 52, 54 provide an air barrier, but not a vapor barrier. The vapor permeable air barrier layers 48, 50 and/or 52, 54 preferably have a water vapor transmission rating of at least 1 perm (1.0 US perm=1.0 grain/square-foot·hour·inch of mercury≈57 SI perm=57 ng/s·m2·Pa) (ASTM E96), preferably at least 5 perms, more preferably at least 10 perms. The vapor permeable air barrier layers 48, 50 and/or 52, 54 should have a an 200% elongation factor of approximately 100%, preferably approximately 200%, more preferably approximately 300%, most preferably approximately 400%, especially approximately 500% and an air permeance of less than 0.004 cfm/sq. ft. under a pressure differential of 0.3 in. water (1.57 psf) (equal to 0.02 L/s.× sq·m. @ 75 Pa). Air permeance is measure in accordance with ASTM E2178. The composite insulated panels 12, 14 should have an assembly air permeance of less than 0.04 cfm/sq·ft. of surface area under a pressure differential of 0.3 in. water (1.57 psf) (equal to 0.2 L/s.×sq·m. of surface area at 75 Pa) when tested in accordance with ASTM E2357. The vapor permeable air barrier layers 48, 50 and/or 52, 54 can be latex, elastomeric, acrylic, and may or may not have fire resistive properties. Air permeance is the amount of air that migrates through a material. Useful liquid applied weather membrane materials include, but are not limited to, Air-Shield LMP by W.R. Meadows, Cartersville, Ga., USA, (a vinyl acetate and ethylene glycol monobutyl ether acetate water-based air/liquid elastomeric vapor permeable air barrier that cures to form a tough, seamless, elastomeric membrane); Perm-A-Barrier VP 20 by Grace Construction Products, W.R. Grace & Co. (a fire-resistive, one component, fluid-applied elastomeric vapor permeable air barrier membrane that protects building envelope from air leakage and rain penetration, but allow the walls to "breathe"); and Tyvek Fluid Applied WB System by E.I. du Pont de Nemours and Company, Wilmington, Del., USA (a fluid applied weather barrier, vapor permeable system). Air-Shield LMP has an air permeability of <0.04 cfm/ft$^2$ @ 75 Pa (1.57 lbs/ft$^2$) (ASTM E2357), an air permeability of <0.004 cfm/ft2 @ 75 Pa (1.57 lbs/ft2) (ASTM E2178), water vapor permeance of 12 perms (ASTM E96) and an elongation of 1000% (ASTM D412). Perm-A-Barrier VP 20 has an air permeance of <0.0006 cfm/ft$^2$ @ 1.57 psf (0.003 L/s·m$^2$ @ 75 Pa) (ASTM E2178).

Figure 3:
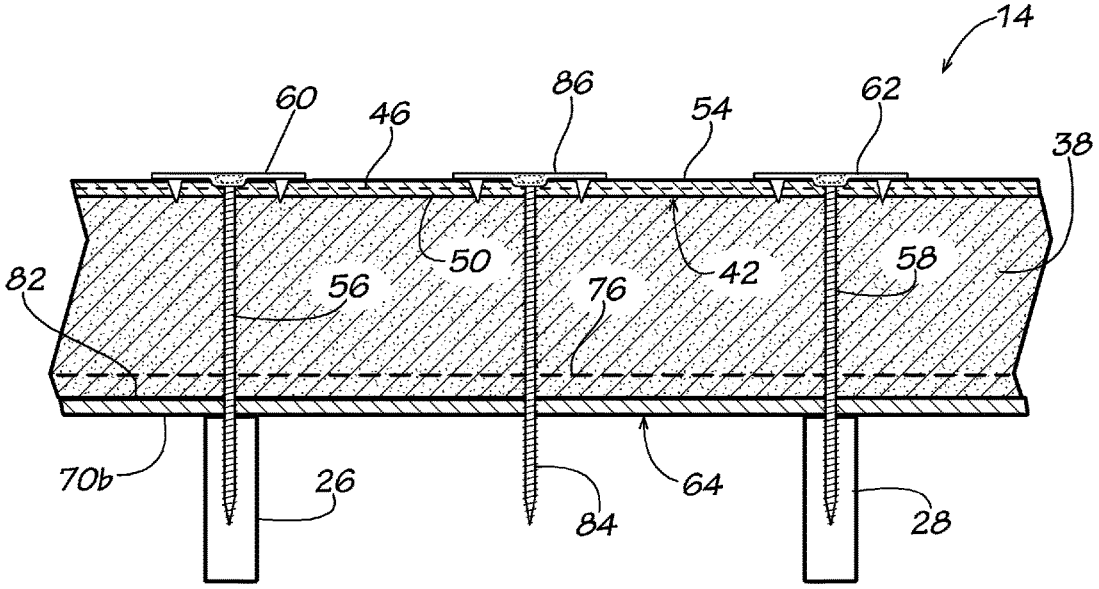
FIG. 3 is a partial cross-sectional view taken along the line 3-3 of the insulated wall sheathing system shown in FIG. 1.
Figure 4:
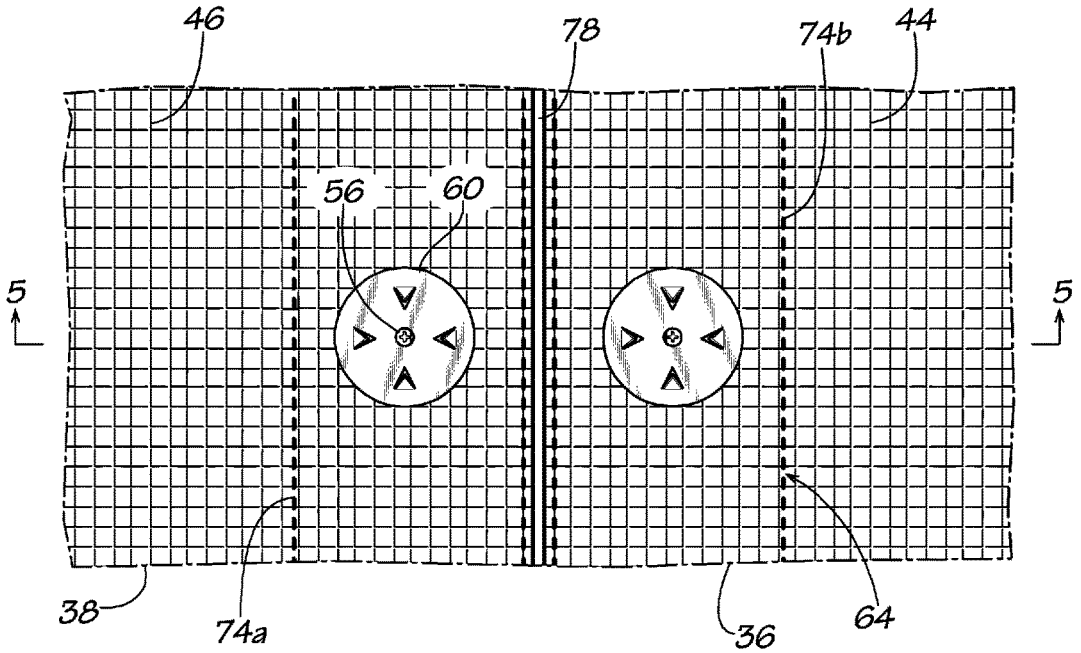
FIG. 4 is a partial detailed plan view of the exterior surface of the composite insulated panels shown in FIG. 1 showing a layer of reinforcing material on each panel and at least partially disposed under each washer and a screw for attaching the composite insulated panel to a building structure.

The composite insulated panels 12, 14 therefore comprise the foam insulating panels 36, 38, the attached layers of reinforcing material 44, 46 and the associated elastomeric vapor permeable air barrier layers 48, 50 and/or 52, 54, respectively. The composite insulated panels 12, 14 are attached to the vertical studs 22-30 by a plurality of screws vertically and horizontally spaced from each other, such as by the screws 56, 58 and associated washers, such as the circular washers 60, 62, 63 (FIGS. 1, 3 and 4). The washers 60, 62 can be made from plastic or preferably are made from metal. As can be seen in FIGS. 3 and 4, at least a portion of the layer of reinforcing material 46 is disposed between the washers 60, 62 and the exterior primary surface 46 of the foam insulating panel 38. To achieve effective structural properties and to resist the positive or negative structural loads that are imposed on the panels 12 and 14 by wind, stack effect, and HVAC fan pressures without rupture, displacement or undue deflection and for the load to be safely transferred to the structure, the screws 56, 58 penetrate through the elastomeric vapor permeable air barrier layers 38 and/or 54, through the layer of reinforcing material 46, through the foam insulating panel 38 and into the studs 26, 28. By capturing the layer of reinforcing material 46 between the exterior surface 42 of the foam insulating panel 38 and each of the washers 60, 62, the structural loads exerted on the foam insulating panel are distributed over a wider area than just the area of the washer; it is also at least partially transferred to the layer of reinforcing material. Notably, none of the layer of reinforcing material 46 covers the screws 56, 58 and the associated washers 60, 62. Such would be counterproductive to the principle of transferring the retaining force of the screws 56, 58 and the associated washers 60, 62 to the layer of reinforcing material 46. Without the screws 56, 58 and the associated washers 60, 62 over the reinforcing material 44, 50 the foam insulating panel 38 will fail. Also, the composite foam panel 14 with an elastomeric coating and laminated fiber reinforced porous material creates a structurally strong foam panel that can resist the structural loads associated with the exterior of a building. A foam panel laminated with films or foils, such as polyethylene film or aluminum foil, are not as strong as a foam insulating panel laminated with a fiberglass grid or mesh and elastomeric vapor permeable air barrier membrane in accordance with the present invention.

Figure 10:
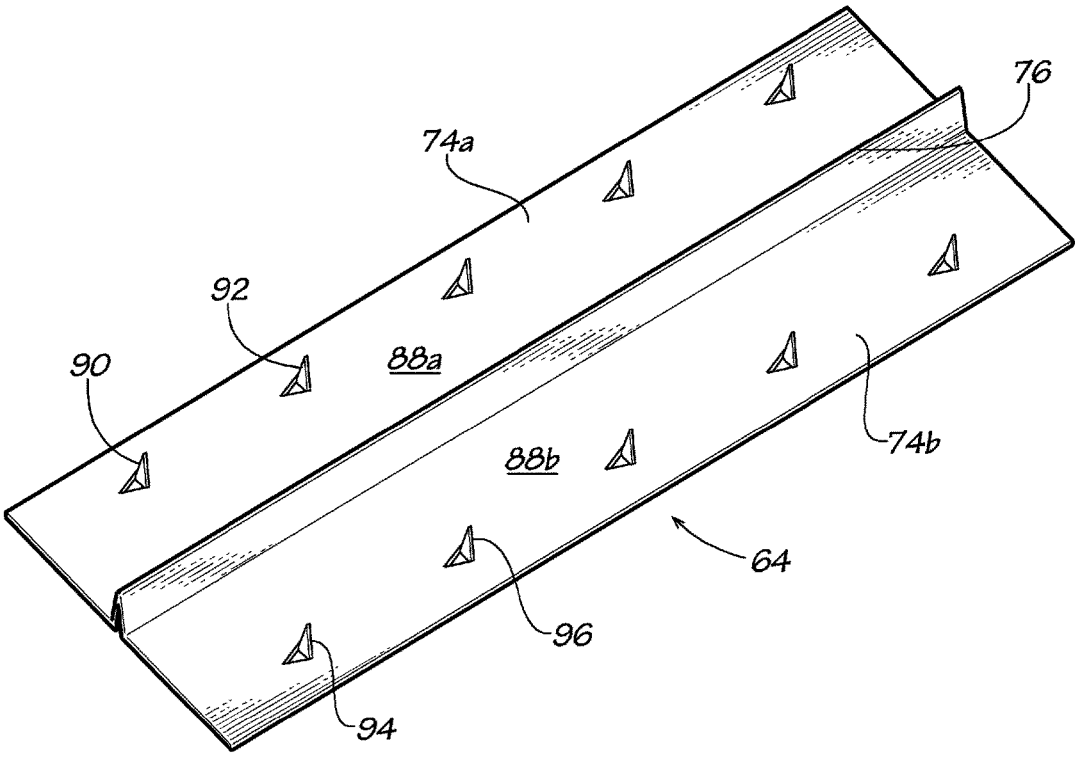
FIG. 10 is a perspective view of a disclosed embodiment of a reinforcing weather strip in accordance with the present invention.
Figure 11:
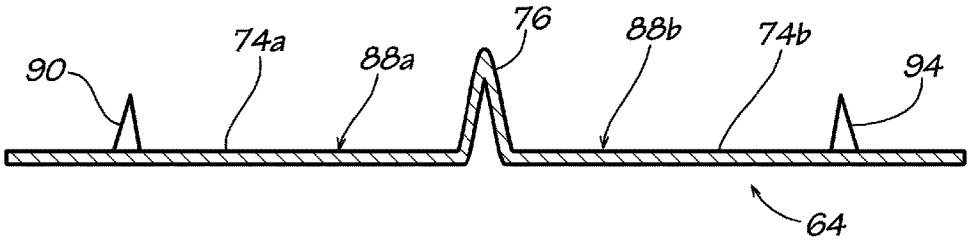
FIG. 11 is an end view of the reinforcing weather strip shown in FIG. 11.
Figure 12:
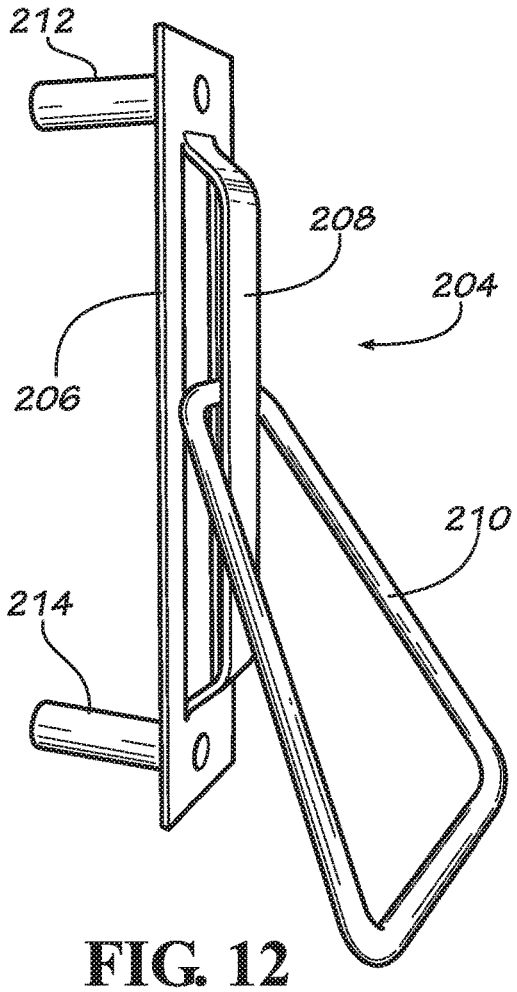
FIG. 12 is perspective view of a disclosed embodiment of a brick tie in accordance with the present invention.
Figure 13:
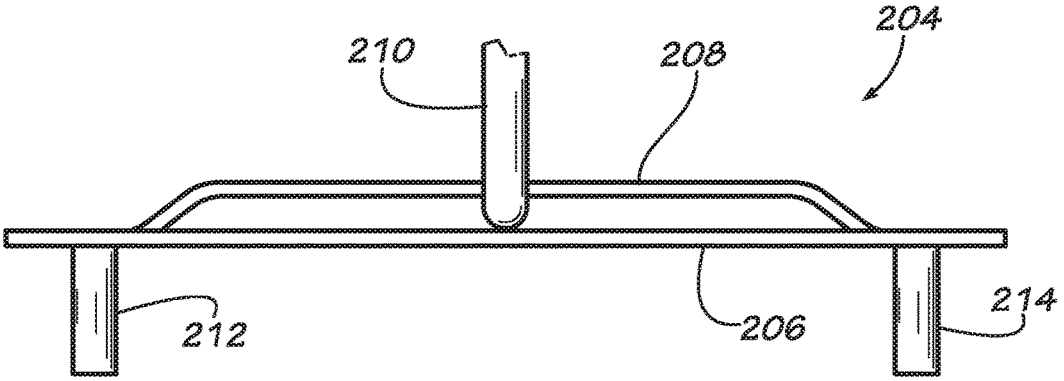
FIG. 13 is a side view of the brick tie shown in FIG. 12.

Optionally, but preferably, before the composite insulated panels 12, 14 are attached to the wall studs 22-30, a T-bar or elongate reinforcing element 64 is attached horizontally to at least two adjacent wall studs, such as the wall studs 22 and 24, but preferably to a plurality of wall studs, as shown in FIG. 1, by for example, screws 66, 68 (FIG. 5) and screws 70, 72 (FIG. 1). The elongate reinforcing element 64 is preferably made from metal, such as steel or aluminum. The elongate reinforcing element 64 preferably has a cross-sectional T-shape. The elongate reinforcing element 64 preferably comprises a flat elongate body members 74*a*, 74*b* and a central longitudinal leg or projection 76 extending outwardly from the body member. The elongate body members 74*a*, 74*b* preferably both are in the same plane and the projection 76 is orthogonal to that plane. The elongate body members 74*a*, 74*b* can be any useful width, but preferably are each approximately 0.5 to 4 inches wide, especially approximately 1 inch wide. The elongate reinforcing element 64 can be any useful length, but preferably is approximately 8 feet long, more preferably approximately 10 feet long and most preferably approximately 12 feet long. The elongate reinforcing element 64 is preferably made by roll forming an elongate, flat piece of metal, especially steel or aluminum. The projection 76 can then be made by bending the metal to make a longitudinally extending V-shaped projection, as best shown in FIGS. 10 and 11. The projection 76 provides rigidity to the elongate reinforcing element 64 so that it resists transverse deflection. By attaching the elongate reinforcing element 64 to adjacent stud, such as the studs 22-20, the elongate reinforcing element provides horizontal shear and buckling resistance to the studs and eliminates or reduces, the requirement for separate horizontal shear reinforcement, such as shear-studs, horizontal struts, noggins, dwangs or blocking. It especially eliminates the use of structural sheathing materials, such a plywood or OSB, typically used to provide the structural shear and buckling reinforcement for exterior walls.

Figure 5:
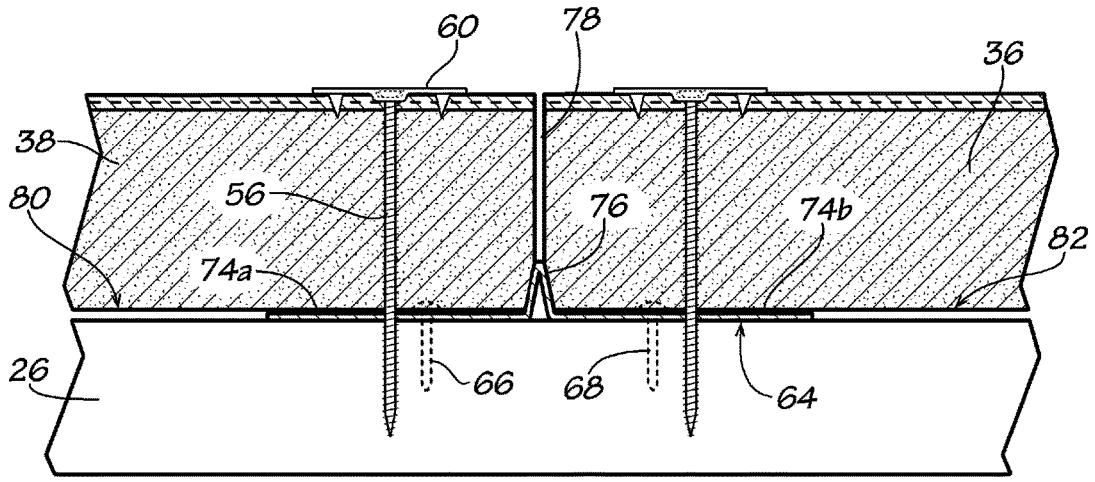
FIG. 5 is a partial cross-sectional view taken along the line 5-5 of the insulated wall sheathing system shown in FIG. 4.

The foam insulating panels 36, 38 are positional with their edges adjacent each other thereby forming a joint 78 therebetween, preferably a longitudinal joint (FIG. 1). Each of the foam insulating panels 36, 38 has an interior surface (a second primary surface) 80, 82 opposite the exterior surfaces 40, 42, respectively. The elongate reinforcing element 64 is positioned so that the projection 76 extends at least partially into the joint 78 between the foam insulating panels 36, 38. The elongate reinforcing element 64 is also positioned so that the body portion 74*a* at least partially covers a portion of the interior surface 80 of the foam insulating panel 36 and so that the body portion 74*b* at least partially covers a portion of the interior surface 82 of the foam insulating panel 38 (FIG. 5). The elongate reinforcing element 64 therefore also reduces, or prevents, water intrusion that may be caused by water getting blown through the joint 78 between the adjacent foam insulating panels 36, 38. The elongate reinforcing element 64 also provides and additional anchoring for the foam insulating panels 36, 38 between adjacent studs, such as between the studs 26, 28 (FIG. 3). For example, a screw 84 and washer 86 can be positioned such that the screw penetrates the foam insulating panel 38 and into the body portion 70*b* of the elongate reinforcing element 64.

After the washers 60, 62, 63, 86 are anchored to the studs, such as the studs 26, 28, a strip of reinforcing material 89 is applied over the joint 78 between the adjacent composite insulated panels 12, 14 and over the washers (FIG. 1). The strip of reinforcing material 89 is made from the same material as the layers of reinforcing material 44, 46 or any other type of compatible material. The strip of reinforcing material 89 extends the length of the composite insulated panels 12, 14 and is wide enough to completely cover the washers 60, 62, 63, 86 (FIG. 1). The strip of reinforcing material 89 is adhered to the composite insulated panels 12, 14 preferably by applying to the strip of reinforcing material an elastomeric vapor permeable air barrier layer 91 made from the same material as the elastomeric vapor permeable air barrier layers 48, 50 and/or 52, 54 so that the strip of reinforcing material is at least partially embedded in the elastomeric vapor permeable air barrier layer 106 (FIG. 1). This provides an elastomeric vapor permeable air barrier over the joint 78 between the adjacent composite insulated panels 12, 14 to eliminate the air infiltration or exfiltration. However, a conventional water resistant adhesive compatible with the elastomeric membrane can also be used to adhere the strip of reinforcing material 78 to the composite insulated panels 12, 14.

Extruded polystyrene foam boards have a vapor permeability of approximately 1 Perm. Expanded polystyrene foam boards have a vapor permeability of approximately 3.5 Perms. Other types of foam boards have lower vapor permeabilities. In many cases, it is desirable to increase the vapor permeability of the insulating foam board. To increase the vapor permeability of the foam board perforation can be made in the foam panel in the manner disclosed in applicant's co-pending patent application Ser. No. 14/229,566 filed Mar. 28, 2014 (the disclosure of which is incorporated herein by reference in its entirety). By laminating the reinforcing material over the perforations the foam board does not lose any of it physical properties.

FIG. 1 shows the composite insulated panels 12, 14 attached directly to the studs 22-30. However, a layer of plywood, gypsum board or other sheathing material (not shown) optionally can be disposed between the composite insulated panels 12, 14 and the studs, as shown in applicant's co-pending patent application Ser. No. 14/229,566 filed Mar. 28, 2014 (the disclosure of which is incorporated herein by reference in its entirety).

Figure 6:
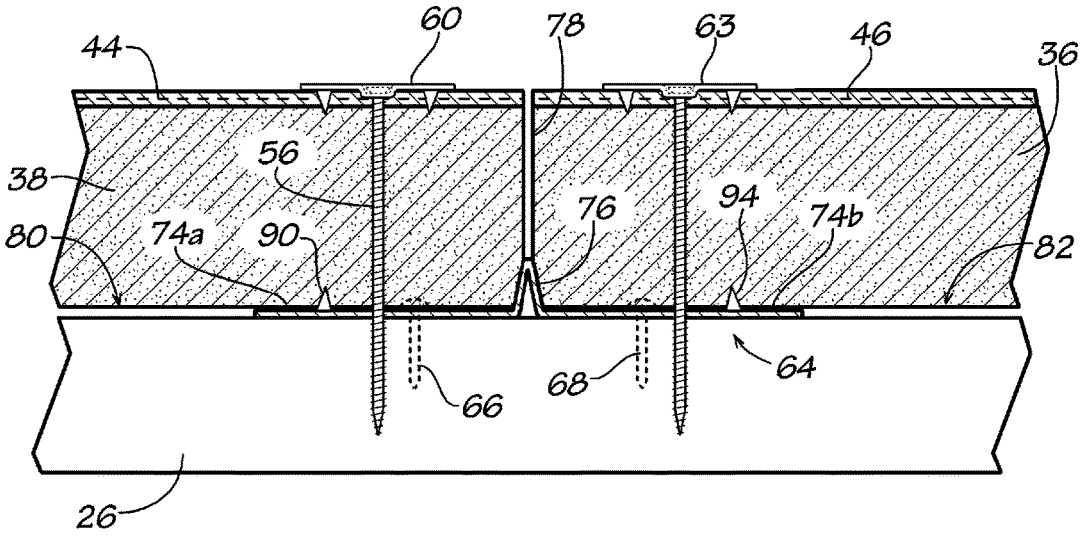
FIG. 6 is a partial cross-sectional view of an alternate disclosed embodiment of the insulated wall sheathing system shown in FIG. 5.

With reference to FIGS. 6, 10 and 11, there is shown another disclosed embodiment for the elongate reinforcing element 64. The elongate reinforcing element 64 has a primary surface 88*a*, 88*b*. The elongate reinforcing element 64 optionally can include a plurality of claws or cleats, such as the cleats 90, 92, extending outwardly from the primary surface 88*a* of the body member 74*a* and longitudinally spaced from each other and a plurality of claws or cleats, such as the cleats 94, 96, extending outwardly from the primary surface 88*b* of the body member 74*b* and longitudinally spaced from each other. The cleats 90-96 extend outwardly in the same direction as the projection 76. The cleats 90-96 are triangular in shape and can be conveniently formed by punching or stamping. However, the shape of the cleats 90-96 can be any suitable shape, such as square or round. When this alternate embodiment of the elongate reinforcing element 64 is attached to the studs 22-30, it is positioned so that the cleats 90-96 face way from the studs. Then, the composite insulated panels 12, 14 are attached as described above. In so doing, the cleats 90-96 at least partially penetrate into the foam insulating panels 36, 38. The cleats 90-96 embedded in the foam insulating panels 36, 38 help anchor the composite insulated panels 12, 14 to the wall structure and reduce movement of the composite insulated panels when subjected to positive or negative pressure, such as wind lifting forces.

Figure 7:
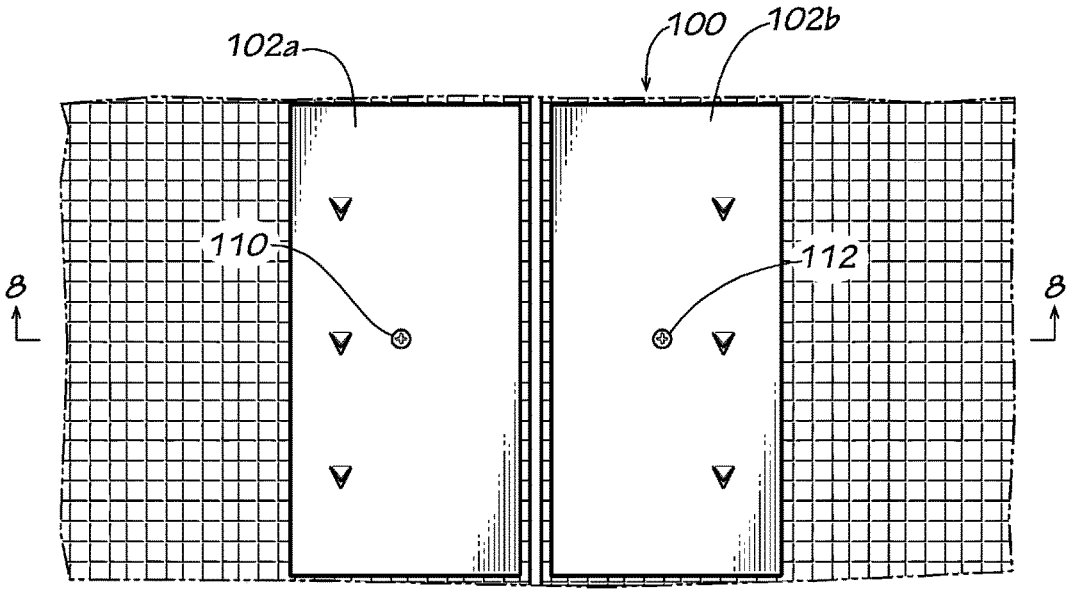
FIG. 7 is a partial top plan view of an alternate disclosed embodiment of the insulated wall sheathing system in accordance with the present invention.
Figure 8:
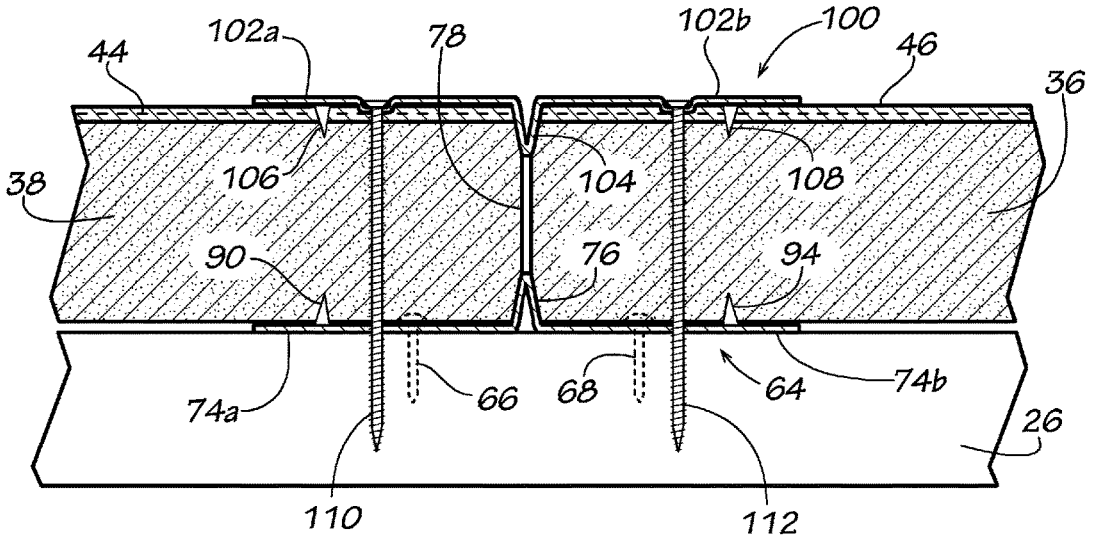
FIG. 8 is a partial cross-sectional view taken along the line 8-8 of the insulated wall sheathing system shown in FIG. 7.

FIGS. 7 and 8 show an alternate disclosed embodiment of the composite insulated panel shown in FIGS. 1-5. The embodiment shown in FIGS. 7 and 8 is identical to the embodiment shown in FIG. 6, except an elongate reinforcing element 100 identical to the elongate reinforcing element 64 is substituted for the washers 60, 63. The elongate reinforcing element 100 preferably comprises flat elongate body members 102*a*, 102*b* and a central longitudinal leg or projection 104 extending outwardly from the body member. The elongate body members 102*a*, 102*b* preferably both are in the same plane and the projection 104 is orthogonal to that plane. The elongate reinforcing element 100 optionally includes a plurality of claws or cleats, such as the cleat 106, extending outwardly from the body member 102*a* and longitudinally spaced from each other and a plurality of claws or cleats, such as the cleat 108, extending outwardly from the body member 102*b* and longitudinally spaced from each other. The cleats 106-108 extend outwardly in the same direction as the projection 104. While the elongate reinforcing element 64 is attached to the studs 22-30 and the composite insulated panels 12, 14 are applied over the elongate reinforcing element 64, the elongate reinforcing element 100 is disposed on the exterior surface (a first primary surface) 40, 42 of each of the foam insulating panels 36, 38, respectively, such that at least a portion of each of the layers of reinforcing material 44, 46 are disposed between the exterior surface of the foam insulating panels and the elongate body members 102*a*, 102*b* of the elongate reinforcing element 100. If the vapor permeable air barrier layers 48, 50 and/or the vapor permeable air barrier layers 52, 54 are present, they will also be disposed between the exterior surface 40, 42 of the foam insulating panels 36, 38 and the elongate body members 102*a*, 102*b* of the elongate reinforcing element 100. The elongate reinforcing element 100 is also positioned so that the projection 104 is at least partially disposed in the joint 78 between the foam insulating panels 36, 38. The elongate reinforcing element 100 is attached with screws, such as the screws 110, 112. The screws 110, 112 may extend into one of the studs, such as the stud 26, or they may extend into the elongate reinforcing element 64. The cleats 106-108 also penetrate into the layers of reinforcing material 44, 46 thereby more securely attaching the composite insulated panels 12, 14 to the elongate reinforcing element 100 and reducing movement of the foam insulating panels 36, 38 relative to the elongate reinforcing element and relative to the vertical studs, such as the stud 26. This helps prevent the composite insulated panels 12, 14 from lifting off of the vertical studs when subjected to negative air pressures.

Figure 9:
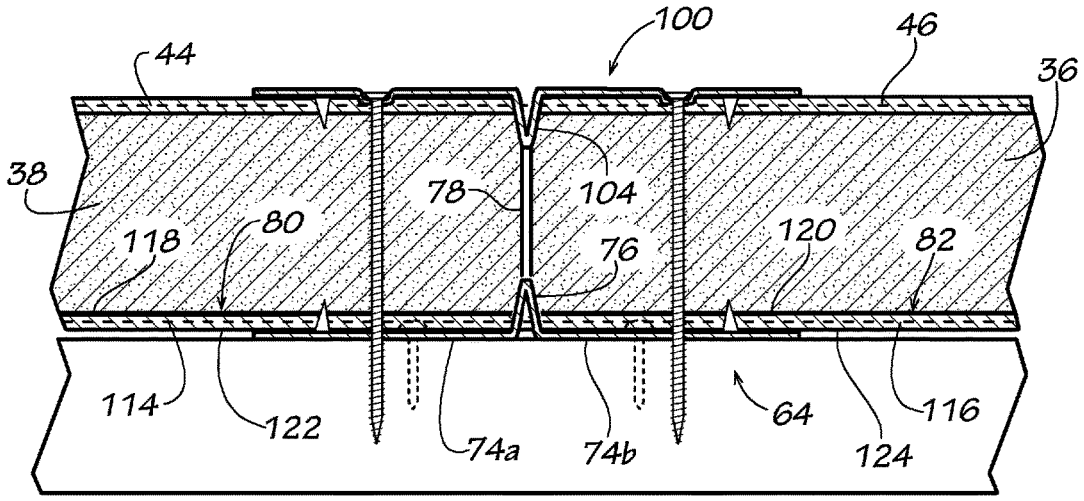
FIG. 9 is a partial cross-sectional view of an alternate disclosed embodiment of the insulated wall sheathing system shown in FIG. 8.

FIG. 9 shows an alternate disclosed embodiment of the composite insulated panel shown in FIG. 8. The embodiment shown in FIG. 9 is identical to the embodiment shown in FIG. 8, except the embodiment shown in FIG. 9 includes layers of reinforcing material 114, 116 on the interior surfaces (second primary surfaces) 80, 82 of the foam insulating panels 36, 38 in addition to the layers of reinforcing material 44, 46 on the exterior surfaces (first primary surface) 40, 42. The interior surfaces 80, 82 also include vapor permeable air barrier layers 118, 120, 122, 124 identical to the vapor permeable air barrier layers 48-54. Thus, the layers of reinforcing material 114, 116 are at least partially embedded in the vapor permeable air barrier layers 118, 120 and/or 122, 124. Thus, at least a portion of the layer of reinforcing material 114 and at least a portion of the vapor permeable air barrier layer 118 and/or 122 is disposed between the body member 74*a* of the elongate reinforcing element 100 and the interior surfaces 80, 82 of the foam insulating panels 36, 38. Similarly, at least a portion of the layer of reinforcing material 116 and at least a portion of the vapor permeable air barrier layer 120 and/or 124 is disposed between the body member 74*b* of the elongate reinforcing element 100 and the interior surfaces 80, 82 of the foam insulating panels 36, 38. Similarly, as described above, the studs of the elongate reinforcing member 64 penetrate into the layers of reinforcing material 114, 116 thereby more securely attaching the composite insulated panels 12, 14 to the elongate reinforcing element 64 and reducing movement of the foam insulating panels 36, 38 relative to the elongate reinforcing element and relative to the vertical studs, such as the stud 26.

FIGS. 1 and 12-15 show a disclosed embodiment of a brick tie 200. As shown in FIG. 1, there are a plurality of brick ties, such as the brick ties 202, 204, which are identical to the brick tie 200, attached to the wall structure 16. The brick tie 200 comprises a base plate 206. The base plate 206 is disclosed as rectangular, but can be any useful shape including, but not limited to, square, round, oval, hexagonal and the like. The base plate 206 is formed from a strong material, such as metal, preferably steel or aluminum. Formed in the base plate 206 is a bridge member 208. The bridge member 208 is conveniently formed from the base plate 206 by stamping. The bridge member 208 is attached to the base plate 206 at each end thereof. The bridge member 208 is spaced from the base plate 206 so that a wire loop 210 can be attached thereto. The base plate 206 and the bridge member 208 define a channel within which the wire loop 210 can rotate and slide from one end of the bridge to the other. Attached to the base member 206 one the side opposite the bridge member 208 and at opposite ends of the base plate are two hollow spacer members 212, 214. The length of the spacer members 212, 214 is equal to the thickness of the composite insulated panels 12, 14. As best shown in FIGS. 14 and 15, the brick tie 204 is attached to one of the studs of the wall structure 16, such as the stud 28, by a pair of screws 216, 218. The screws 216, 218 extend through holes (not shown) the base plate 206, through the spacer members 212, 214, respectively, and into the stud 28. Since the spacer members 212, 214 are the same length as the thickness of the composite insulated panels 12, 14, when the screws 216, 218 are tightened down the base place will not significantly compress the composite insulated panels. In addition, the spacer members 212, 214 provide structural support to the forces transferred from the brick wall cladding to the framing systems without damaging or altering the properties of the insulating sheathing board. As shown in FIGS. 1 and 15, the brick ties, such as the brick tie 204, are positioned such that the wire loop 210 can be positioned between adjacent rows of brick, such as the rows of brick 220, 222. When mortar 224 is applied to the row of brick 220, the wire loop 210 is placed in the mortar. After the row of brick 222 is placed on top and the mortar 224 hardens, the brick tie 204 is firmly anchored to the brick wall, which in turn is anchored to the wall structure 16.

Optionally, to increase their rigidity and structural properties, the composite insulated panels 12, 14 include a layer of cementitious material 300. The layer of cementitious material 300 is applied to the layers of reinforcing material 44, 46 and/or to the elastomeric vapor permeable air barrier layers 52, 54. The layer of cementitious material 300 is applied in any desired thickness. However, the layer of cementitious material 300 is usually applied in a thickness of 1/32 inch to 1 inch, preferably 1/8 inch to 1/2 inch. Additionally, the thickness and composition of the cementitious layer 300 can be adjusted to increase or decrease the vapor permeability of the cementitious layer. The layer thickness and composition of the layer of cementitious material can also be adjusted to increase the fire resistance of the composite insulated panel.

Optionally, a layer of a decorative exterior cladding material (not shown) can be directly applied to the layers of reinforcing material 44, 46, the elastomeric vapor permeable air barrier layers 52, 54 or the layer of cementitious material 300 using a conventional notched trowel adhesive, such as thin set or the like. The decorative exterior cladding material includes, but are not limited to, thin brick, stone, tile, marble, plaster, stucco, cement board, cement siding, wood siding, composite siding, vinyl siding, aluminum siding and the like. The exterior wall cladding is adhesively attached to the layers of reinforcing material 44, 46 and/or the air barrier membrane 52, 54 using an adhesive. This method of attachment eliminates the need for mechanical fasteners associated with various installations of exterior wall claddings, and, therefore, eliminates the air barrier perforation associated with the use of mechanical fasteners. In this embodiment, the polymeric elastomeric vapor permeable air barrier membrane remains intact to perform as intended without any damage from penetration. The polymeric elastomeric vapor permeable air barrier membrane 52, 54 has very good bonding properties thereby acting as a bond enhancer between the decorative exterior wall claddings and the foam insulating panel 36, 38. Alternatively, the decorative exterior cladding material can be adhesively attached to the cementitious layer 300 using an adhesive as described above.

While the layer of cementitious material 300 in accordance with the present invention can be made from conventional concrete, mortar or plaster mixes; i.e., concrete mortar or plaster in which portland cement is the only cementitious material used in the concrete mortar or plaster, it is preferred as a part of the present invention to use the concrete mortar or plaster mixes disclosed in U.S. Pat. No. 8,545,749 (the disclosure of which is incorporated herein by reference in its entirety). Concrete mortar or plaster is a composite material consisting of a mineral-based hydraulic binder which acts to adhere mineral particulates together in a solid mass; those particulates may consist of coarse aggregate (rock or gravel), fine aggregate (natural sand or crushed fines), and/or unhydrated or unreacted cement. Specifically, the concrete, plaster and mortar mixes in accordance with the present invention comprise cementitious material, aggregate and water sufficient to at least partially hydrate the cementitious material. The amount of cementitious material used relative to the total weight of the concrete, mortar or plaster varies depending on the application and/or the strength of the concrete desired. Generally speaking, however, the cementitious material comprises approximately 25% to approximately 40% by weight of the total weight of the concrete, exclusive of the water, or 300 lbs/yd$^3$ of concrete (177 kg/m$^3$) to 1,100 lbs/yd$^3$ of concrete (650 kg/m$^3$) of concrete. The water-to-cementitious material ratio by weight is usually approximately 0.25 to approximately 0.7. Relatively low water-to-cementitious material ratios lead to higher strength but lower workability, while relatively high water-to-cementitious material ratios lead to lower strength, but better workability. Aggregate usually comprises 60% to 80% by volume of the concrete, mortar or plaster. However, the relative amount of cementitious material to aggregate to water is not a critical feature of the present invention; conventional amounts can be used. Nevertheless, sufficient cementitious material should be used to produce concrete mortar or plaster with an ultimate compressive strength of at least 1,000 psi, preferably at least 2,000 psi, more preferably at least 3,000 psi, most preferably at least 4,000 psi, especially up to about 10,000 psi or more.

While the foregoing invention has been disclosed as being useful as a wall sheathing system, it is specifically contemplated that the present invention can be used as a roofing system. For a roofing system, the composite insulated panels 12, 14 can be attached to plywood sheeting overlaying roofing rafters (not shown). A fluid applied roof membrane (not shown) can be applied to the layers of reinforcing material 44, 46, the elastomeric vapor permeable air barrier layer 54 and/or the layer of cementitious material 300. Fluid applied roof membranes are well known in the art. For example, Kemper System America, Inc., West Seneca, N.Y., USA sells a line of fluid applied roof membrane products including Kempertec EP/EP5-Primer with silica sand, Kempertec D-Primer, Kempertec AC primer with silica sand, Kempertec BSF-R Primer, Kemperol 2K-PUR with 165 fleece, Kemperol BR/BR-M with 165 fleece, and Kempertec TC traffic surfacing. These products are polyurethane-based, polyester-based and polymethylmethacrylate-based.

Sika Corporation, Lyndhurst, N.J., USA offers a fluid applied roof membrane product under the designation Sikalastic® RoofPro Liquid Applied Membrane. This product includes Sika® Bonding Primer (a two component prereacted epoxy resin dispersed in water and a waterborne modified polyamine solution), Sikalastic® 601 BC and Sikalastic® 621 TC are both moisture cured polyurethane-based systems. Sika® Reemat and Flexitape systems are a nylon mesh reinforcing system.

Siplast USA, Irving, Tex., USA offers a fluid applied roof membrane product under the designation Parapro PMMA Roof Membrane System. This product includes primers designated Pro Primer R, Pro Primer W and Pro Primer T (all polymethylmethacrylate based resins); Paradiene 20 underlayment and Parapro Roof Membrane Resin (a polymethylmethacrylate based resin).

Alternatively, a polymeric roofing membrane can be used with the composite insulated panels 12, 14. The polymeric roofing membrane (not shown) can be applied to the layers of reinforcing material 44, 46, the elastomeric vapor permeable air barrier layer 54 and/or the layer of cementitious material 300. On top of the seam tape and layer of cementitious material, if present, or the layer of reinforcing material, if the layer of cementitious material is not present, are first and second sheets of polymeric roof membrane, such as EPDM (ethylene propylene diene monomer (M-call) rubber), PVC (polyvinyl chloride) or TPO (thermoplastic polyolefin). The polymeric roof membrane is attached to the layer of cementitious material, if present, or the layer of reinforcing material by a suitable adhesive. TPO membranes can also be attached by using mechanical fasteners and washers in a manner well know in the art. The first sheet of polymeric roof membrane is attached to the second sheet of polymeric roof membrane by methods known in the art, such as by hot air welding.

Firestone Building Product, Indianapolis, Ind., USA offers a TPO roof membrane system designated UltraPly TPO Roofing System and an EPDM roof membrane system under the designation RubberGard EPDM. GAF Corp., Wayne, N.J., USA offers a TPO roof membrane system designated EverGardTPO single ply roofing membrane. Overlapping sheets of TPO roofing membrane are joined together by hot air welding.

Figure 16:
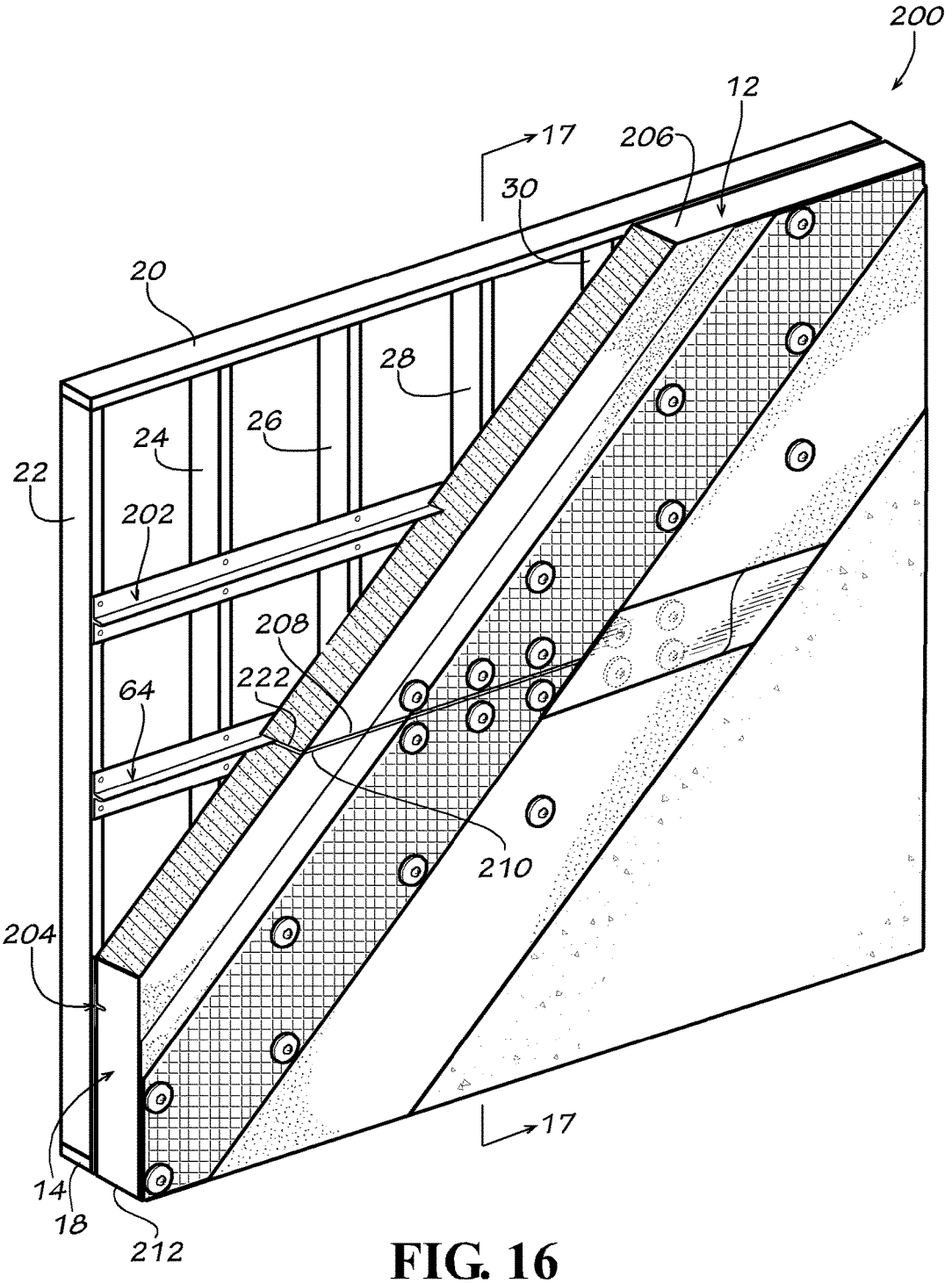
FIG. 16 is a partially cut away perspective view of another disclosed embodiment of an insulated wall sheathing system in accordance with the present invention.
Figure 17:
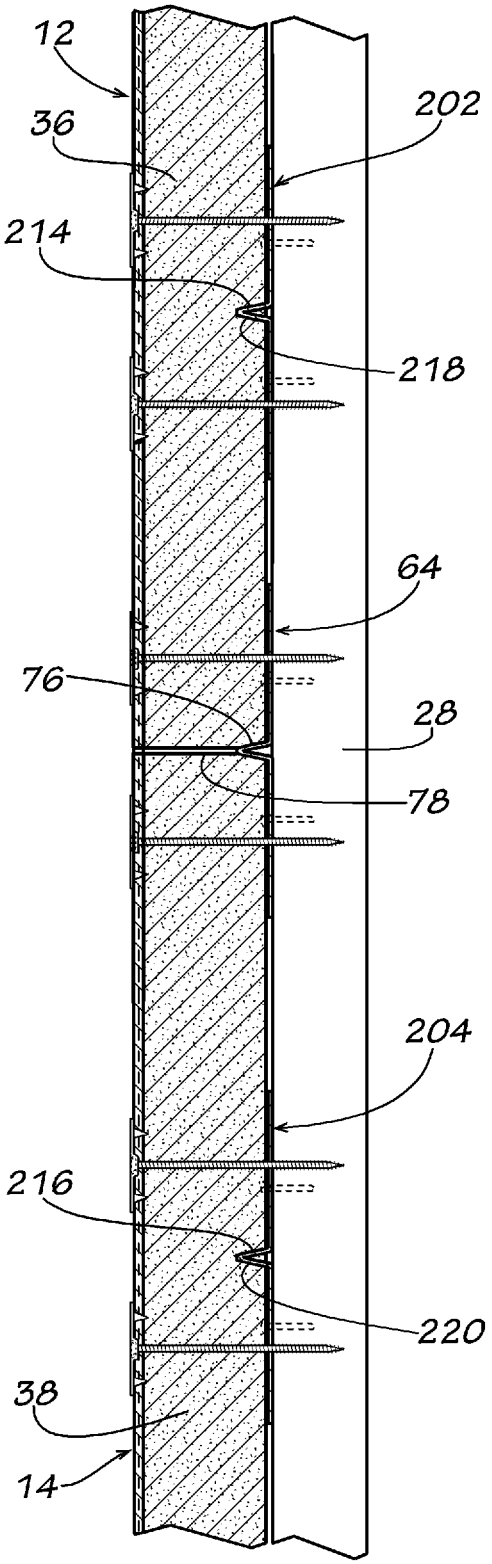
FIG. 17 is a partial cross-sectional view taken along the line 17-17 of the insulated wall sheathing system shown in FIG. 16.

FIGS. 16 and 17 show another disclosed embodiment of the insulated sheathing system 200 in accordance with the present invention. The insulated sheathing system 200 is identical to the insulated sheathing system 100 shown in FIG. 1, except that the insulated sheathing system 200 comprises three elongate reinforcing members 64, 202, 204. The elongate reinforcing members 202, 204 are identical to the elongate reinforcing member 64. However, as shown in FIG. 16, the elongate reinforcing members 202, 204 are disposed intermediate the upper and lower edges of the composite insulated panels 12, 14. The composite foam panel 12 includes an upper edge 206 and a lower edge 208; the composite foam panel 14 includes an upper edge 210 and a lower edge 212. The elongate reinforcing member 202 is disposed at approximately at the mid-point (such as at 24" for a 48" panel) of the distance between the upper edge 206 and the lower edge 208. Similarly, the elongate reinforcing member 204 is disposed at approximately at the mid-point of the distance between the upper edge 210 and the lower edge 212. The elongate reinforcing members 202, 204 are attached to the vertical studs 22-30 in the same manner as the elongate reinforcing member 64.

The elongate reinforcing elements 202, 204 have a cross-sectional T-shape. Each of the elongate reinforcing members 202, 204 include a central longitudinal leg or projection 214, 216, respectively, extending outwardly from the body member. In order to accommodate the projections 214, 216, a channel 218, 220 is cut in the interior surface (second primary surface) 80, 82 of each of the foam insulating panels 36, 38. The channel 218, 220 is of a size and a shape to accommodate the projections 214, 216, such as a V-shaped groove. The channels 218, 220 can be cut into the interior surfaces 80, 82 of the foam insulating panels 36, 38 by a router or a hot wire.

The elongate reinforcing elements 64, 202, 204 are first attached to the vertical studs 22-30. For example, the elongate reinforcing elements 64, 202, 204 can be attached horizontally and vertically spaced intervals, such as every 24". Then the composite insulated panels 12, 14 are attached to the studs in the manner described above. The composite insulated panel 12 is positioned so that the projection 214 of the elongate reinforcing member 202 fits into the channel 218 and the elongate reinforcing member 64 is positioned at the lower edged 208 of the composite insulated panel 12. Then, the composite insulated panel 14 is positioned so that the projection 216 of the elongate reinforcing member 204 fits into the channel 216 and the elongate reinforcing member 64 is positioned at the upper edged 210 of the composite insulated panel 14 in the joint 222 formed between the composite insulated panels 12, 14. The composite insulated panels 12, 14 are then attached to the elongate reinforcing elements 64, 202, 204 in the same manner as described above. By using a second elongate reinforcing member at the mid-point of the composite insulated panel, additional support is provided to the panel. This may be particularly desirable when plywood sheathing is not used under the foam insulating panels.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A product comprising:

a first foam panel having an edge, a first primary surface and an opposite second primary surface;

a first layer of reinforcing material substantially covering and adhered to the first primary surface of the first foam panel;

a second foam panel having an edge, a first primary surface and an opposite second primary surface, wherein the first and second foam panels are disposed such that their edges are adjacent each other and define a joint therebetween;

a second layer of reinforcing material substantially covering and adhered to the first primary surface of the second foam panel;

a first elongate metal strip having a body member and a projection extending outwardly from the body portion, the metal strip being disposed such that at least a portion of the projection is disposed in the joint between the first and second foam panels and at least a portion of the body member covers a portion of the first layer of reinforcing material on the first foam panel and a portion of the second layer of reinforcing material on the second foam panel; and wherein the first and second, layers of reinforcing material are attached to the first foam insulating panel with a vapor permeable air barrier material having a vapor transmission rate of at least 1 perm and an air permeance of less than 0.004 cfm/sq. ft. under a pressure differential of 0.3 inches of water.

2. The product of claim 1 further comprising:

a third layer of reinforcing material substantially covering and adhered to the second primary surface of the first foam panel; and a fourth layer of reinforcing material substantially covering and adhered to the second primary surface of the second foam panel.

3. The product of claim 2 further comprising:

a second elongate metal strip having a body member and a projection extending outwardly from the body portion, the metal strip being disposed such that at least a portion of the projection is disposed in the joint between the first and second foam panels and at least a portion of the body member covers a portion of the third layer of reinforcing material on the first foam panel and a portion of the fourth layer of reinforcing material on the second foam panel.

4. The product of claim 3, wherein the first elongate metal strip has a plurality of cleats extending outwardly from the body member and wherein at least some of the plurality of cleats extend through the first and second layers of reinforcing materials and into the first and second foam panels.

5. The product of claim 4, wherein the second elongate metal strip has a plurality of cleats extending outwardly from the body member and wherein at least some of the plurality of cleats extend through the third and fourth layers of reinforcing materials and into the first and second foam panels.

6. The product of claim 3 further comprising a fastener penetrating the first elongate metal strip, the first layer of reinforcing material the first foam insulating panel, the third layer of reinforcing material and the second elongate metal strip.

7. The product of claim 6 further comprising a fastener penetrating the first elongate metal strip, the second layer of reinforcing material the second foam insulating panel, the fourth layer of reinforcing material and the second elongate metal strip.

8. The product of claim 7, wherein the first, second, third and fourth layers of reinforcing material are each porous.

9. The product of claim 7, wherein the first, second, third and fourth layers of reinforcing material are woven or nonwoven materials.

10. The product of claim 7, wherein the first, second, third and fourth layers of reinforcing material are vapor permeable.

11. The product of claim 7, wherein the first and second, layers of reinforcing material are attached to the first foam insulating panel with a polymeric material.

* * * * *